US009561678B2

(12) United States Patent
Yamaguchi

(10) Patent No.: US 9,561,678 B2
(45) Date of Patent: Feb. 7, 2017

(54) IMAGE PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yoichi Yamaguchi, Gotenba Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/662,025

(22) Filed: Mar. 18, 2015

(65) Prior Publication Data

US 2016/0271989 A1 Sep. 22, 2016

(51) Int. Cl.
*B41J 2/325* (2006.01)
*B41M 7/00* (2006.01)

(52) U.S. Cl.
CPC ..... *B41M 7/0009* (2013.01)

(58) Field of Classification Search
CPC G03G 15/5062; G03G 15/2039; G03G 21/00; B41J 2/4753; B41J 11/002; B41J 2/315; B41M 7/0009; B41M 2205/18; B41M 5/34
USPC ..... 430/19; 347/102, 171, 179
See application file for complete search history.

(56) References Cited

U.S. PATENT DOCUMENTS 8,405,696 B2 3/2013 Yahata et al.
2010/0239280 A1* 9/2010 Inoue ..... G03G 21/08 399/44
2012/0212564 A1* 8/2012 Yamamoto ..... B41J 2/4753 347/225

FOREIGN PATENT DOCUMENTS

JP 2010-130372 6/2010

* cited by examiner

*Primary Examiner* — Jannelle M Lebron
(74) *Attorney, Agent, or Firm* — Patterson & Sheridan, LLP

(57) ABSTRACT

An image processing apparatus includes a light emitting unit that emits light, a document reading unit, an image forming unit, a decoloring unit, and a control unit. The document reading unit generates image data from an original document that is irradiated with light from the light emitting unit. The image forming unit forms an image on a sheet based on the image data generated by the document reading unit, wherein the image is formed of a decolorable material that is decolored when heated to a predetermined temperature or higher. The decoloring unit decolors the image on the sheet using heating. The control unit controls a light intensity of the light emitted from the light emitting unit based on a temperature of the decoloring unit.

19 Claims, 6 Drawing Sheets

FIG. 5

SETTING TABLE

| TEMPERATURE OF HR | NUBER OF PROCESSSED SHEETS SUBJECTED TO DECOLORING IN PREVIOUS JOB | |
|---|---|---|
| | O SHEETS TO 50 SHEETS | EQUAL TO OR GREATER THAN 50 SHEETS |
| T<T1 | α 1 | α 2 |
| T≧T1 | α 2 | α 3 |

α1, α2, α3: CURRENT VALUE (where α1<α2<α3)
T: CURRENT TEMPERATURE
T1: SETTING TEMPERATURE

FIG. 6

PREDETERMINED CONDITION 1 (SCANNING ONLY)

| NUMBER OF SHEETS IN MIDDLE OF EXECUTING PROCESS | TEMPERATURE OF HR | |
|---|---|---|
| | T<T1 | T≧T1 |
| n<N | α 1 (or α 2) | α 2 (or α 3) |
| n≧N | α 1 | α 1 (or α 2) |

n : EXECUTING PROCESS
N : THRESHOLD VALUE

FIG. 7

PREDETERMINED CONDITION 2
(SCANNING AND DECOLORING)

| NUMBER OF SHEETS IN MIDDLE OF EXECUTING PROCESS | LIGHT INTENSITY |
|---|---|
| $m < M$ | a 1 (or a 2 or a 3)<br>(NOT CHANGING FROM LIGHT INTENSITY AT TIME OF START) |
| $m \geqq M$ | a 2 (or a 3)<br>(RAISING BY ONE LEVEL FROM LIGHT INTENSITY AT TIME OF START) |

m : EXECUTING PROCESS

M : THRESHOLD VALUE

IMAGE PROCESSING APPARATUS

FIELD

Embodiments described herein relate generally to an image processing apparatus which includes a decoloring function.

BACKGROUND

In the related art, a system in which an image processing apparatus which may perform printing using a non-decolorable color material is used in combination with an image processing apparatus which may perform printing using a decolorable color material. Similarly, a system may include these apparatuses in integrated form. An image on a sheet as a decoloring target is stored in the image processing apparatus such as an image reading device which automatically reads the image using a scanner and an automatic document feeder (ADF).

As a light emitting unit of the scanner, a solid light emitting element such as an LED is used. It is understood that a light intensity of the solid light emitting element decreases along with a temperature rise. When an image which is formed using a decolorable color material that is decolored using heat, a temperature rise due to a heater becomes significant. When the original document is read using a scanner, there is a problem in that it is not possible to obtain a sufficient light intensity from the light emitting unit, and to perform normal reading, due to an influence of the temperature rise in the apparatus.

DESCRIPTION OF THE DRAWINGS

FIG. 5 illustrates an example setting table.

FIG. 6 illustrates a table with a predetermined condition 1.

FIG. 7 illustrates a table with a predetermined condition 2.

DETAILED DESCRIPTION

Embodiments provide an image processing apparatus which may obtain a stable image quality by adjusting a light intensity of a light emitting unit in a scanner which reads the original document.

In general, according to one embodiment, an image processing apparatus includes a light emitting unit that emits light. A document reading unit generates image data from an original document that is irradiated with light from the light emitting unit. An image forming unit forms an image on a sheet based on the image data generated by the document reading unit. The image is formed of a decolorable material that is decolored when heated to a predetermined temperature or higher. A decoloring unit decolors the image on the sheet using heating. A control unit controls a light intensity of the light emitted from the light emitting unit based on a temperature of the decoloring unit.

Hereinafter, embodiments will be described in detail with reference to drawings.

Figure 1:
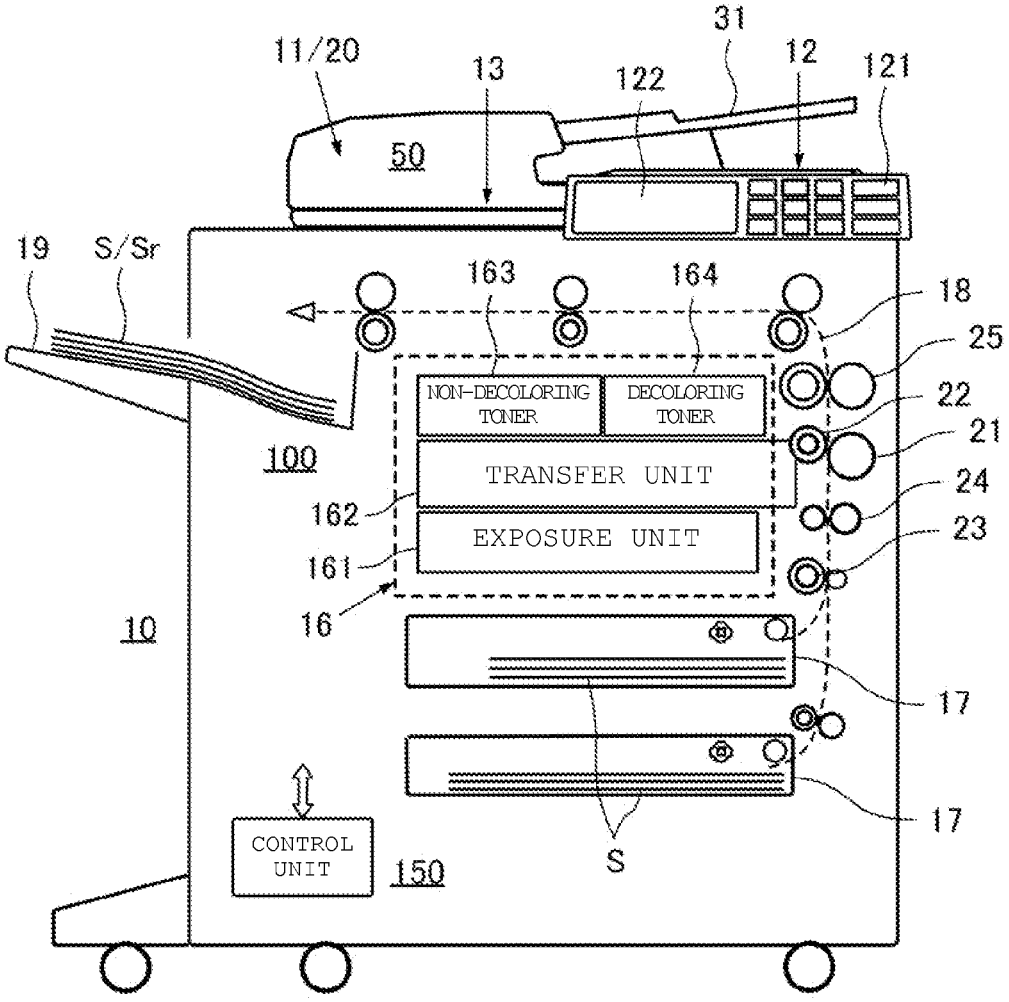
FIG. 1 is a schematic diagram illustrating an image processing apparatus according to an embodiment.
Figure 2:
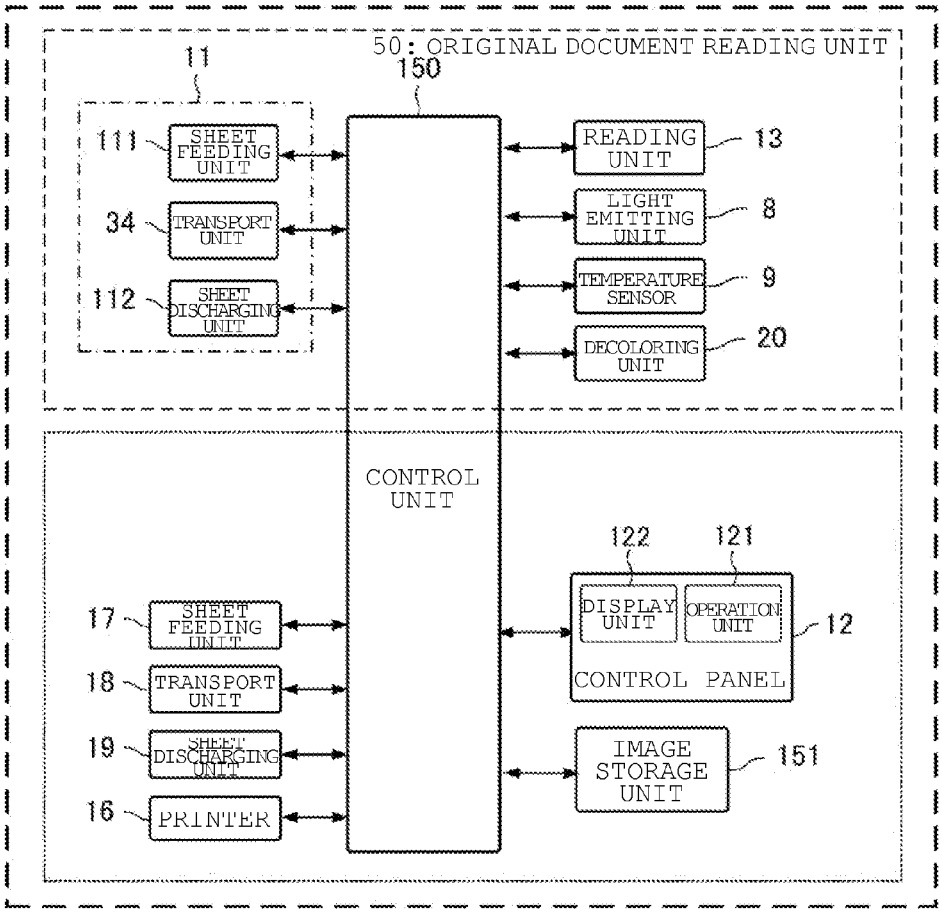
FIG. 2 is a block diagram illustrating a hardware configuration of the image processing apparatus.

FIG. 1 is a schematic diagram of an image processing apparatus 10. FIG. 2 is a block diagram which illustrates a hardware configuration example of the image processing apparatus 10.

The image processing apparatus 10 includes an original document reading unit 50, and an image forming unit 100. A control unit 150 generally controls the image processing apparatus 10. The control unit 150 includes a Central Processing Unit (CPU), a Read Only Memory (ROM), a Random Access Memory (RAM), a non-volatile memory, and the like, which are not illustrated. Various programs are stored in the ROM, and each function of the image processing apparatus 10 is executed when the CPU executes processes according to these programs. The RAM is used as a work memory which temporarily stores various data for use when the CPU executes the program. User information or various setting information to be kept even when power supply is turned off is stored in the non-volatile memory.

The image processing apparatus 10 may be configured as a so-called Multi-Function Peripheral (MFP) which includes a scanning function, a copying function, a printer function, and the like. In the scanning function, image data is obtained by optically reading the original document. In the copying function, the original document is read, and then a copied image of the original document is printed on a recording sheet based on image data which is obtained through the reading. In the printer function, an image which is obtained by rasterizing print data received from an external terminal is printed on a sheet.

In addition, the image processing apparatus 10 has a decoloring function in which a sheet which has been already printed using decoloring toner (a decolorable coloring agent) is decolored. The sheet that has been decolored may be reused as a printing sheet. The decoloring function may be performed by heating the sheet.

The document reading unit 50 includes an automatic document transport unit 11, a reading unit 13, a light emitting unit 8, a temperature sensor 9, and the like. In addition, a decoloring unit 20 is included in the document reading unit 50.

The automatic document transport unit 11 includes a sheet feeding unit 111, a transport unit 34, and a sheet discharging unit 112. The automatic document transport unit 11 separates the original documents which are set in an original document table one by one, feeding the document, and transporting the original document to a discharging place through a transport path on which the original document passes through a predetermined reading position. The automatic document transport unit 11 will be further described later.

The control panel 12 includes an input unit 121 which has various keys, and a display unit 122. The control panel 12 displays various information such as setting information or an operation status of the image processing apparatus 10.

The input unit 121 may include, for example, a ten key for inputting the number of sheets to be printed, a FAX number, an ID number, a mail address, and the like. The input unit 121 may also include, for example, a scanning key, a copying key, a facsimile key, a mail delivering key, a sheet selecting key, a start key, and the like. In addition, the input unit 121 may also include, for example, an input key for inputting numerals, or the like, a keyboard, a mouse, a touch panel, a touch pad, a pen tablet, an exclusive button, and the like.

The display unit 122 may be configured of, for example, electronic paper, a liquid crystal display (LCD), an electronic luminescence (EL), or the like. In addition, when the display unit 122 is configured using a touch panel display, it is also possible for the display unit 122 to perform a part or all of the functions of the input unit 121.

The reading unit 13 is a general image reading unit which is included in an image sensor copier, an image scanner, or the like. The image processing apparatus 10 is used when copying or scanning the original document. The reading unit 13 is an example of an input unit which reads the original document and generates image data to be printed. In addition, it is also possible for the reading unit 13 to receive the original document which is transmitted from a personal computer as an external terminal in the input unit, and print the original document as image data.

The decoloring unit 20 is disposed in the transport unit 34 which transports the original document in the automatic original document transport unit 11. The decoloring unit 20 has a function of decoloring the sheet which has been already printed using decoloring toner by heating the sheet. The decoloring unit 20 will be described later.

The image forming unit 100 includes the control panel 12, a printer 16, the sheet feeding unit 17, the transport unit 18, the sheet discharging unit 19, an image storage unit 151, and the like.

The image storage unit 151 is a non-volatile mass storage device which is used when storing image data obtained by performing reading in the reading unit 13, or the like. For example, in the embodiment, the image storage unit 151 includes a hard disk drive and a controller thereof.

The printer 16 includes an exposure unit 161, a transfer unit 162, non-decoloring toner 163, decoloring toner 164, and the like. The printer 16 is an image forming unit, and includes a laser exposure unit, or the like. The printer 16 processes image data which is read in the reading unit 13, image data which is created using a personal computer, or the like, and forms an image on a sheet S. The sheet on which the image is formed using the printer 16 is discharged to the sheet discharging unit 19.

The decoloring toner 164 (which is a decolorable color material) may be subjected to a "decoloring process" in which an image formed using a decolorable color material is erased with respect to a sheet on which the image is formed. The decolorable color material includes a coloring compound, a developer, and a decoloring agent. As the coloring compound, leuco dye may be used, for example. As the developer, phenols may be used, for example. As the decoloring agent, a substance may be used which is compatible with a coloring compound when being heated and has no affinity to a developer. The decolorable color material is developed due to an interaction between a coloring compound and a developer, and is decolored when the interaction between the coloring compound and the developer is stopped due to heating to a decoloring temperature or more. As the decolorable color material, decoloring ink or the like may be used, in addition to decoloring toner.

In addition, the "decoloring" according to the embodiment means that an image formed using a color which is different from a ground color of a sheet (including neutral color such as white color, black color, or the like, not only chromatic color) is caused to not be viewed visually, or is caused to be difficult to view visually. Here, "caused to not be viewed visually" may be a case in which an image which is formed using a color different from a ground color of a sheet is changed to the same color as the ground color of the sheet, or a similar color thereto, in addition to a case of making the image which is formed using the color different from the ground color of the sheet colorless (transparent).

The exposure unit 161 scans a laser beam which is output from a semiconductor laser element, and is modulated according to image data using a polygon mirror in the axis line direction of a photosensitive drum (not illustrated) which rotates. An electrostatic latent image is formed on the photosensitive drum when the laser beam is radiated.

The transfer unit 162 includes an endless intermediate transfer belt which performs an intermediate transfer of the electrostatic latent image on the photosensitive drum. The image which is transferred to the intermediate transfer belt is further transferred to a transfer roller 21. The intermediate transfer belt extends around a driving roller 22, and is driven by the driving roller.

In addition, the transport path 18 includes a separation roller 23 which takes out the sheet S in the sheet feeding unit 17. A resist roller 24 is provided on the transport path 18. The transport path extends from the sheet feeding unit 17 including a sheet feeding roller to a sheet discharging unit 19 including a sheet discharging roller.

The sheet S is taken out using the separation roller 23 and is transported to a secondary transfer position between the intermediate transfer belt where a primary transfer is performed between the resist roller 24 and the transfer roller 21. When the sheet S passes through the secondary transfer position, a secondary transfer voltage is applied to the sheet S using the transfer roller 21. A toner image on the intermediate transfer belt is secondarily transferred to the sheet S.

Downstream of the resist roller 24 in the transport direction, a fixing unit 25 is provided at a position of passing through the transfer unit 162. The sheet discharging unit 19 is provided downstream of the fixing unit 25. The sheet S on which a toner image is fixed using the fixing unit 25, and then the sheet on with the toner image is fixed is discharged by the sheet discharging unit 19. In addition, when performing duplex printing, the sheet S is guided to the direction of the transfer roller 21 after being reversed on a reversing transport path (not illustrated).

Figure 3:
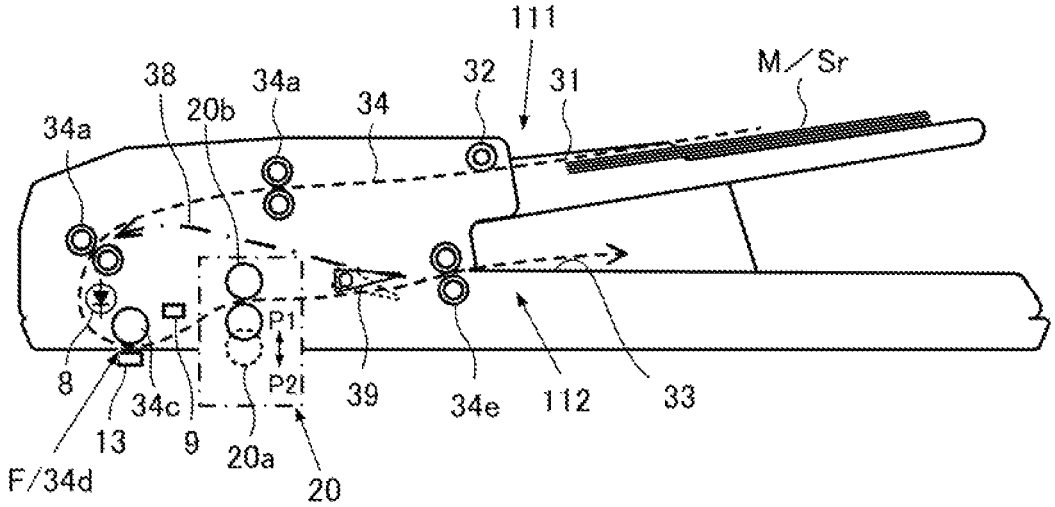
FIG. 3 is a schematic diagram illustrating a document reading portion.

Here, the automatic original document transport unit 11, the reading unit 13, and the decoloring unit 20 will be further described with reference to FIG. 3.

The automatic original document transport unit 11 is a unit which transports a plurality of original documents M, or a plurality of sheets Sr on which an image is formed using decoloring toner, which are set in an original document table 31 by separating the original document M and the sheet Sr one by one, reads the original document M or the sheet Sr, and discharges the original document M or the sheet Sr. The automatic original document transport unit 11 is configured of the sheet feeding unit 111, the transport unit 34, the reading unit 13, and the sheet discharging unit 112.

The sheet feeding unit 111 includes the original document table 31, and a feeding roller 32 which feeds the original documents M which are placed on the original document table 31 by separating the original document one by one from the document on the top.

In the transport unit 34, the original document M which is fed using the feeding roller 32 is denoted using an arrow of a dashed line in the drawing. The original document is transported to a sheet discharging tray 33 through a reading position F of the reading unit 13.

The transport unit 34 includes a guide wall (not illustrated) which is provided along a transport path 34, a plurality of pair of transport rollers **34*a* which convey the original document therebetween, an output roller 34*b*, an adhering roller 34*c* which presses the original document from the rear face so that the original document adheres to the reading position F, and a transport motor (not illustrated) which rotatably drives the transport roller 34***a*, the output roller 34*b*, and the adhering roller 34*c*, and the like.

The transport path 34 forms a laterally U-shaped path from the original document table 31 to the sheet discharging tray 33 on the lower side, the reading position F is located slightly on the downstream side of a bent portion of the U shape, and a slit 34*d* is provided on the guide wall of the transport path 34 in the portion of the reading position F. The reading unit 30 reads the original document through the slit 34*d*.

The decoloring unit 20 heats the original document which passes through the transport path 34 to a temperature at which decolorable color material is decolored. The decoloring unit 20 is provided on the transport path 34 at a predetermined position downstream of the reading position F.

The decoloring unit 20 includes a heating roller 20*a* with an electric heater which is heated by being electrically connected, for example, and a transport roller 20*b*. The heating roller 20*a* is held using a mechanism which is displaced to a position of P1 at a time of heating, and to a position of P2 at a time of non-heating. For example, the mechanism may be displaced with a spring which urges the heating roller 20*a* to non-contact position P2 and a solenoid which displaces the heating roller 20*a* to the contact position P1 when electrically connected against the spring, or the like. In the heating roller 20*a*, the sheet face contact position P1 is denoted by a solid line, and the sheet face non-contact position P2 is denote by a broken line.

Whether the position of the heating roller 20*a* is set to the contact position P1 or to the non-contact position P2 is determined by the control unit 150. The heating roller 20*a* may be electrically connected in conjunction with the movement of the positions P1 and P2 due to a control of the control unit 150, for example.

A temperature of the decoloring unit 20 is monitored using the temperature sensor 9 which is provided in the vicinity of the heating roller 20*a* in the decoloring unit 20, or at an axis end portion of the heating roller. Detection information of the temperature sensor 9 is supplied to the control unit 150.

A sheet on which an image formed using decoloring toner is present may be subjected to decoloring of the image when passing through the heating roller 20*a* which is present at the sheet face contact position P1 by being heated by the heating roller.

The sheet discharging unit 112 includes a discharging roller 34*e* which discharges the sheet which is transported on the transport path 34 to a discharging tray 33, and the discharging tray 33.

In addition, the automatic original document transport unit 11 includes a switchback path 38, which is denoted by an arrow with dashed line in the drawing, for resending the original document which passes through the reading position F to the upstream side of the reading position F in order to reverse the front face and the rear face thereof. The switchback path 38 includes a guide wall which forms a passage of the original document, and a switching lever 39 which switches the passage of the original document. The switching lever 39 is urged by a spring so that a tip end thereof is normally located at a position which is slightly turned upward. The switching lever 39 is denoted by a solid line in the drawing, and is located at a reversed position in which the tip end thereof is slightly turned downward as denoted by a broken line in the drawing against the spring due to the solenoid, when being electrically connected.

In addition, when there is no switchback path 38 in the decoloring unit 20, it is possible decolor both sides of a sheet which are recorded with images using decoloring toner by adopting a heating roller including a displacement mechanism also in the transport roller 20*b*.

In this manner, the automatic original document transport unit 11 transports different sheets of the original document M which is a printing target, and of the sheet Sr on which an image is formed using the decoloring toner. In a case of the original document M, printing is performed using the non-decoloring toner 163 or the decoloring toner 164 based on image data which is read in the reading unit 13. Whether to perform printing using the non-decoloring toner 163 or to perform printing using the decoloring toner 164 is selected when an operator operates the control panel 12.

In addition, in the sheet Sr on which an image is formed using decoloring toner, the image of the sheet Sr is decolored when the operator operates the control panel 12, and the sheet Sr may be reused.

Subsequently, adjusting of a light intensity of the light emitting unit 8 which is performed along with a change in temperature in the temperature sensor, when the operation mode is only the scanning process, and when the operation mode is the scanning process and the decoloring process will be described with reference to FIGS. 4 to 7. According to the embodiment, there is a mode in which only a scanning process of reading an image on the sheet Sr in the original document reading unit is performed, and another mode in which the scanning process and the decoloring process are performed by heating and decoloring the image on the sheet Sr in the decoloring unit 20, after reading the image on the sheets Sr in the original document reading unit.

Figure 4:
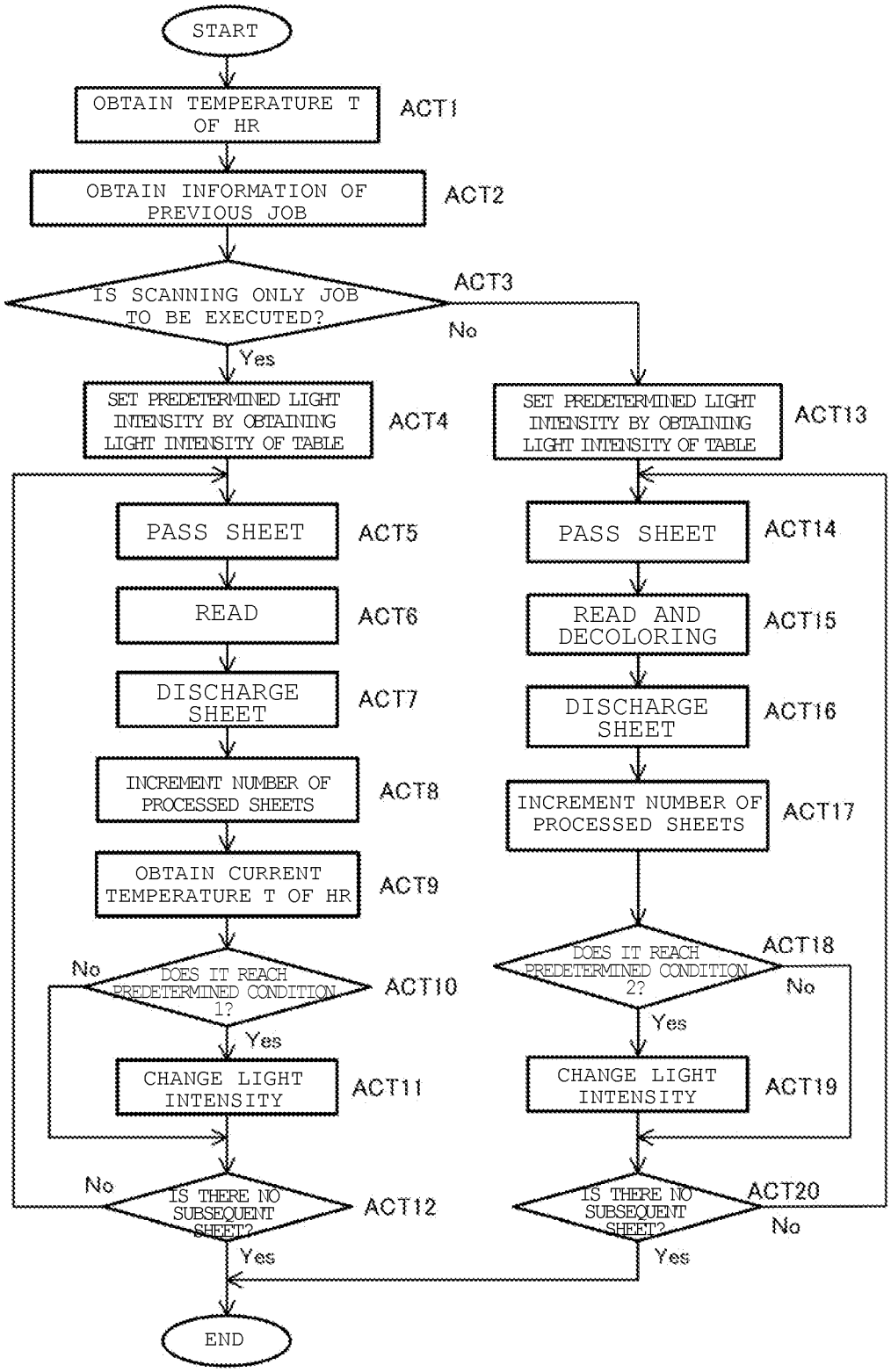
FIG. 4 is a flowchart illustrating an example sequence of operations for adjusting a light intensity of a light emitting unit.

FIG. 4 illustrates a flowchart illustrating an example sequence of operations for controlling a light intensity of the light emitting unit 8 which is executed by the control unit. The control unit 150 obtains temperature information of the heating roller 20*a* from the temperature sensor 9 (ACT 1). Subsequently, the control unit obtains information of a job which is previously executed by the original document reading unit (ACT 2). For example, information on whether a job of only a scanning process is executed in the previous job or jobs of the scanning process and a decoloring process are executed is obtained.

In ACT 3, whether a job to be executed from now on is only the scanning process is determined. In other words, whether a decoloring process is included in the process to be executed from now on is determined.

In ACT 3, when determining that only the scanning process is to be executed (Yes in ACT 3), a current value flowing in the light emitting unit 8 is set based on information on a current temperature T of the heating roller 20*a*, and based on information on the number of sheets which is subjected to the decoloring process in the previous job (hereinafter, referred to as "the number of decolored sheets") in ACT 4. Here, the value of the current which is caused to flow in the light emitting unit 8 is set based on the table in FIG. 5.

The light intensity of the light emitting unit 8 may be changed when the control unit 150 adjusts the current which is caused to flow in the light emitting unit 8.

FIG. 5 is a table of a setting value of a current based on the current temperature T of the heating roller 20*a*, and the number of decolored sheets in the previous job.

Here, when the current temperature T is lower than a preset temperature T1, and the number of decolored sheets in the previous job is between 0 and 50, a current setting value as a first current is set to $\alpha 1$. When the number of decolored sheets in the previous job is equal to or greater than 50, a current setting value as a second current is set to $\alpha 2$. When the current temperature T is equal to or higher than the preset temperature T1, and the number of decolored sheets in the previous job is 0 to 50, a current setting value is set to $\alpha 2$. When the number of decolored sheets in the previous job is equal to or greater than 50, a current setting value as a third current is set to $\alpha 3$. Here, a relationship in each current setting value is set to $\alpha 1<\alpha 2<\alpha 3$.

The current setting value is set to be large (relation of $\alpha 2>\alpha 1$) compared to the case in which the number of decolored sheets in the previous job is 0 to 50, when the current temperature T of the heating roller 20*a* is lower than the preset temperature T1 and when the number of decolored sheets in the previous job is equal to or greater than 50 is that a temperature in the apparatus rises at the time of starting a job, because the decoloring unit 20 is operated for a long time in the previous job. For this reason, when the number of decolored sheets in the previous job is equal to or greater than 50, it is necessary to set the value of the current which is caused to flow in the light emitting unit to be large, because there is a concern that a light intensity of the light emitting unit may decrease due to a temperature rise in the apparatus compared to the case in which the number of decolored sheets in the previous job is 0 to 50.

When setting of the value of the current which is caused to flow in the light emitting unit ends in ACT 4, the control unit 150 drives the sheet feeding unit 111 and the transport path of the automatic original document transport unit 11, and causes the sheet which is mounted on the original document table 31 to pass (ACT 5). The image contents of the sheet are then read using the reading unit 13 (ACT 6). Image data which is read in the reading unit 13 is stored in the image storage unit 151, and the sheet is discharged to the sheet discharging unit 112 (ACT 7).

The control unit 150 confirms the discharging of sheet and performs an increment process of increasing the number of processed sheets by one (ACT 8). The control unit 150 obtains the current temperature T of the heating roller 20*a* through the temperature sensor 9 (ACT 9). It is assumed that the reason why the current temperature T of the heating roller 20*a* is obtained in ACT 9 is because the temperature of the automatic original document transport unit 11 decreases, since the heating roller 20*a* is not driven in a case in which only the scanning process is performed (processes in ACT 4 to ACT 12). Accordingly, there is a possibility that the value of the current which is caused to flow in the light emitting unit, and is set in ACT 4 may be adjusted, and it is necessary to confirm the current temperature T.

Subsequently, the control unit 150 determines whether a predetermined condition 1 illustrated in FIG. 6 is reached (ACT 10), and the process proceeds to ACT 11 when reaching the condition (Yes in ACT 10).

The predetermined condition 1—which is used when the job to be executed in ACT 3 is only the scanning process—is set to a table in FIG. 6, for example. A current value is set to $\alpha 1$ (or $\alpha 2$) when a relationship between the number of processed sheets n and the number of sheets of a threshold value N is $n<N$, and when a relationship between the current temperature T of the heating roller 20*a* and the preset temperature T1 is $T<T1$. Here, the number of processed sheets n is the number of sheets n which is subjected to the scanning process. In addition, the number of sheets of the threshold value N is a predetermined value for changing the value of the current which is caused to flow in the light emitting unit. That is, when the relationship between the current temperature T of the heating roller 20*a* and the preset temperature T1 is $T<T1$, and when the number of the processed sheets n does not exceed the number of sheets of the threshold value N (that is, when $n<N$) in ACT 10, the value is not changed from the current value which is set in ACT 4.

Similarly, in ACT 10, a current value is set to $\alpha 2$ (or $\alpha 3$) when the relationship between the number of processed sheets n and the number of sheets of the threshold value N is $n<N$, and the relationship between the current temperature T and the preset temperature T1 is $T\geq T1$. Also in this case, similar to the above descriptions, the level is not changed from the current value which is set in ACT 4. That is, when the number of processed sheets n does not exceed the number of sheets of the threshold value N, the current value which is set in ACT 4 is not changed in ACT 10.

On the other hand, a current value is set to $\alpha 1$ when a relationship between the number of processed sheets n and the number of sheets of the threshold value N is $n\geq N$, and the relationship between the current temperature T and the preset temperature T1 is $T<T1$. In this case, when the current value is set to $\alpha 2$ in ACT 4, the current value is changed to $\alpha 1$ from $\alpha 2$. Alternatively, when the current value is set to $\alpha 1$ in ACT 4, the current value $\alpha 1$ is maintained as is without being changed. Here, the reason why the value of the current which is caused to flow in the light emitting unit is set to be small when the relationship between the number of processed sheets n and the number of sheets of the threshold value N is $n\geq N$ is because a temperature in the housing falls compared to a case in which the decoloring unit is used, when the scanning process is performed with respect to sheets which exceed the predetermined number. Accordingly, the light intensity of the light emitting unit is adjusted by resetting a current to a value which is smaller than the current value set in ACT 4.

In addition, a current is set to $\alpha 1$ (or $\alpha 2$) when a relationship between the number of processed sheets n and the number of sheets of the threshold value N is $n\geq N$, and $T\geq T1$. In this case, when the current value is set to $\alpha 3$ in ACT 4, the value is set to the current value of $\alpha 2$ which is smaller than $\alpha 3$. In addition, when the current value is set to $\alpha 2$ in ACT 4, the value is set to the current value of $\alpha 1$ which is smaller than $\alpha 3$. Here, the reason why the value of the current which is caused to flow in the light emitting unit is set to be small when the relationship between the number of processed sheets n and the number of sheets of a threshold value N is $n\geq N$ is because a temperature in the housing falls compared to the case in which the decoloring unit is used, when the scanning process is performed with respect to sheets which exceed the predetermined number. Accordingly, the light intensity of the light emitting unit is adjusted by setting a current to a value that is smaller than the current which is set in ACT 4.

In ACT 11, the value is changed to a current value based on the predetermined condition 1, and the process proceeds to ACT 12. When it is determined that the predetermined condition 1 is not met in ACT 10 (No in ACT 10), the process proceeds to ACT 12.

In ACT 12, whether there is no subsequent sheet to be scanned is determined. When there is a subsequent sheet to be scanned (No in ACT 12), the process returns to ACT 5, and the scanning process is repeated. When it is determined that there is no subsequent sheet to be scanned in ACT 12 (Yes in ACT 12), the process ends.

When it is determined that a job to be executed from now on is not only the scanning process in ACT 3 (No in ACT 3), the process proceeds to ACT 13. For example, if the job to be executed is a job which includes the decoloring process in addition to the scanning process, the determination in ACT 3 is No.

In ACTs 13 to 17, the scanning process and the decoloring process are performed. In ACTs 13 to 17, the same processes as those in ACTs 5 to 8 are performed except for ACT 15, in which the process is different from that in ACT 6. That is, in ACT 15, the image on the sheet which is mounted on the original document table 31 in ACT 14 is read, and is subjected to a decoloring process.

When the increment process of increasing counting of the number of processed sheets by one is completed in ACT 17, the process proceeds to ACT 18.

The control unit 150 determines whether the predetermined condition 2 is reached (ACT 18). If the predetermined condition 2 is met (Yes in ACT 18), the process proceeds to ACT 19.

In addition, the predetermined condition 2 at the time of scanning process and decoloring process is set according to a table in FIG. 7, for example. A current value is set to $\alpha 1$ (or $\alpha 2$ or $\alpha 3$) when a relationship between the number of processed sheets m and the number of sheets of a threshold value M is $m<M$. Here, the number of processed sheets m means the number of sheets which are subjected to the scanning process and the decoloring process. In addition, the number of sheets of a threshold value M is a predetermined value for changing a value of a current which is caused to flow in the light emitting unit.

That is, when the number of processed sheets m does not exceed the number of sheets of the threshold value M (that is, when $m<M$), the value is not changed from the current value which is set in ACT 13. Here, it is assumed that the reason why the amount of current which is set in ACT 13 is not changed in ACT 18 is because a temperature in the apparatus does not rise, since the predetermined number of sheets M is not subjected to the decoloring process. Accordingly, it is assumed that the light intensity of the light emitting unit does not decrease, and it is not necessary to change the current value which is caused to flow in the light emitting unit.

On the other hand, the light intensity is set to $\alpha 2$ (or $\alpha 3$) when a relationship between m and M is $m \geq M$. In this case, when the current value is set to $\alpha 1$ in ACT 13, a value of a current which is caused to flow in the light emitting unit is set to be large, and is set to $\alpha 2$. In addition, when the current value is set to $\alpha 2$, a value of a current which is caused to flow in the light emitting unit is set to be large, and is set to $\alpha 3$. In addition, when the current value is set to $\alpha 3$ in ACT 13, it is set so that $\alpha 3$ is maintained. Here, it is assumed that the reason why the current value which is set in ACT 4 is changed in ACT 18 is because a temperature in the apparatus rises compared to a time of starting a job when the decoloring process is performed with respect to sheets which exceed the predetermined number of sheets M. Accordingly, it is assumed that the light intensity of the light emitting unit decreases along with the temperature rise in the apparatus. For this reason, in order to suppress a decrease in light intensity of the light emitting unit, it is necessary to increase a value of a current which is caused to flow in the light emitting unit.

In ACT 19, the value is changed to a current value based on the predetermined condition 2, and the process proceeds to ACT 20. In ACT 18, when it is determined that the predetermined condition 2 is not met (No in ACT 18), the process proceeds to ACT 20.

In ACT 20, whether there is no subsequent sheet to be scanned is determined. When there is a sheet to be scanned (No in ACT 20), the process returns to ACT 14, and the scanning and decoloring processes are repeated. When there is no subsequent sheet in ACT 20 (Yes in ACT 20), the process ends.

In addition, a process with respect to each sheet is illustrated in the flowchart in FIG. 4. It is also possible to employ a configuration in which a plurality of sheets is collectively processed. In addition, the current temperature T is obtained as temperature information by measuring a temperature of the heating roller 20*a* using the temperature sensor 9. However, the current temperature may be predicted from an elapsed time after the heating roller 20*a* is electrically connected.

In this manner, a change in value of the current which is caused to flow in the light emitting unit 8 based on the predetermined condition 1 or 2 is performed in a case of performing the scanning process only, and in a case of performing the scanning process and the decoloring process. In this manner, it is possible to suitably maintain the light intensity of the light emitting unit 8 which is associated with the change in temperature, and to secure a light intensity which is necessary for scanning.

According to the embodiment, it is possible to adjust the light intensity of the light emitting unit corresponding to different operation modes. In this manner, it is possible to obtain a stable image quality.

The exemplary embodiment is not limited to the above described embodiment. For example, the decoloring unit 20 is incorporated into the automatic original document transport unit 11 of which a capacity is relatively small. However, the decoloring unit may be provided in the vicinity of the printer 16. In this case, the decoloring unit 20, and a transport unit of a sheet on which an image is formed using decoloring toner in the decoloring unit 20 are separately configured from the automatic original document transport unit 11.

In addition, according to the embodiment, a function of decoloring, a function of printing, and a function of copying are configured to be so-called all in one by the associated components being arranged in the same housing. It may be a configuration in which at least the decoloring unit 20 has a housing which is separate from the components for printing, or the components for copying. In such an arrangement, the decoloring unit 20 may be connected through a LAN or the like to the components for printing or for copying, which may have a separate housing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image processing apparatus comprising:

a light emitting unit configured to emit light;

a document reading unit configured to generate image data from an original document that is irradiated with light from the light emitting unit;

an image forming unit configured to form an image on a sheet based on the image data generated by the document reading unit, the image being formed of a decolorable material that is decolored when heated to a predetermined temperature or higher;

a decoloring unit configured to decolor the image on the sheet using heating; and a control unit configured to control a light intensity of the light emitted from the light emitting unit based on a temperature of the decoloring unit.

2. The apparatus according to claim 1, wherein the control unit is further configured to operate a current processing job in either of a first mode in which a reading process of the document reading unit is performed and a decoloring process in the decoloring unit is not performed, and a second mode in which the reading process is performed and the decoloring process is performed, such that in the first mode, the light intensity of the light emitting unit is controlled based on:

a temperature of a heating roller which heats the sheet in the decoloring unit, and a number of sheets subjected to the decoloring process performed in the decoloring unit during a processing job immediately prior to the current processing job.

3. The apparatus according to claim 2, wherein when the control unit is operating the current processing job in the first mode:

the control unit sets a current in the light emitting unit to a first predetermined current value if a number of sheets subjected to the reading process performed in the document reading unit during the current processing job is less than a predetermined number, and if the temperature of the heating roller is less than a predetermined temperature, and the control unit sets the current in the light emitting unit to a second predetermined current value larger than the first predetermined current value if the number of sheets subjected to the reading process in the document reading unit is equal to or greater than the predetermined number, and if current temperature of the heating roller is equal to or greater than a predetermined setting temperature.

4. The apparatus according to claim 2, wherein when the control unit is operating the current processing job in the first mode:

the control unit sets a current in the light emitting unit to a first predetermined current value if a number of sheets subjected to the reading process performed in the document reading unit during the current processing job is less than a predetermined number, and if the temperature of the heating roller is less than a predetermined temperature, and the control unit sets a current in the light emitting unit to the first predetermined current value or higher if the number of sheets subjected to the reading process performed in the document reading unit during the current processing job is less than the predetermined number, and if the temperature of the heating roller is equal to or greater than a predetermined temperature.

5. The apparatus according to claim 2, wherein when the control unit is operating the current processing job in the second mode:

the control unit sets a current in the light emitting unit to a first predetermined current value if a number of sheets subjected to the reading process performed in the document reading unit during the current processing job is less than a predetermined number, and the control unit sets the current in the light emitting unit to a second predetermined current value larger than the first predetermined current value if the number of sheets subjected to the reading process in the document reading unit is equal to or greater than the predetermined number.

6. The apparatus according to claim 1, wherein the control unit controls the light intensity of the light emitting unit in a current processing job based on:

a number of sheets subjected to the decoloring process performed in the decoloring unit during a processing job immediately prior to the current processing job, and a temperature of a heating roller in the decoloring unit.

7. The apparatus according to claim 6, wherein the temperature of the heating roller is a temperature predicted from an elapsed time after the heating roller is energized.

8. A controller for controlling an image processing apparatus that includes a light emitting unit configured to emit light, a document reading unit configured to generate image data from an original document that is irradiated with light from the light emitting unit, an image forming unit configured to form an image on a sheet based on the image data generated by the document reading unit, and a heating roller configured to decolor the image on the sheet using heating, the controller comprising:

a control unit configured to control a light intensity of the light emitted from the light emitting unit based on a temperature of the heating roller.

9. The controller according to claim 8, wherein the control unit is further configured to operate a current processing job in either of a first mode in which a reading process of the document reading unit is performed and a decoloring process in the heating roller is not performed, and a second mode in which the reading process is performed and the decoloring process is performed, such that in the first mode, the light intensity of the light emitting unit is controlled based on:

a temperature of the heating roller which heats the sheet, and a number of sheets subjected to the decoloring process performed during a processing job immediately prior to the current processing job.

10. The controller according to claim 9, wherein when the control unit is operating the current processing job in the first mode:

the control unit sets a current in the light emitting unit to a first predetermined current value if a number of sheets subjected to the reading process performed in the document reading unit during the current processing job is less than a predetermined number, and if the temperature of the heating roller is less than a predetermined temperature, and the control unit sets the current in the light emitting unit to a second predetermined current value larger than the first predetermined current value if the number of sheets subjected to the reading process in the document reading unit is equal to or greater than the predetermined number, and if current temperature of the heating roller is equal to or greater than a predetermined setting temperature.

11. The controller according to claim 9, wherein when the control unit is operating the current processing job in the first mode:

the control unit sets a current in the light emitting unit to a first predetermined current value if a number of sheets subjected to the reading process performed in the document reading unit during the current processing job is less than a predetermined number, and if the temperature of the heating roller is less than a predetermined temperature, and the control unit sets a current in the light emitting unit to the first predetermined current value or higher if the number of sheets subjected to the reading process performed in the document reading unit during the current processing job is less than the predetermined number, and if the temperature of the heating roller is equal to or greater than a predetermined temperature.

12. The controller according to claim 9, wherein when the control unit is operating the current processing job in the second mode:

the control unit sets a current in the light emitting unit to a first predetermined current value if a number of sheets subjected to the reading process performed in the document reading unit during the current processing job is less than a predetermined number, and the control unit sets the current in the light emitting unit to a second predetermined current value larger than the first predetermined current value if the number of sheets subjected to the reading process in the document reading unit is equal to or greater than the predetermined number.

13. The controller according to claim 8, wherein the control unit controls the light intensity of the light emitting unit in a current processing job based on:

a number of sheets subjected to the decoloring process performed in the heating roller during a processing job immediately prior to the current processing job, and a temperature of a heating roller, the temperature being one of a temperature predicted from an elapsed time after the heating roller is energized and a measured temperature of the heating roller.

14. An image processing apparatus comprising:

a light emitting unit configured to emit light;

a document reading unit configured to generate image data from an original document that is irradiated with light from the light emitting unit;

an image forming unit configured to form an image on a sheet based on the image data generated by the document reading unit, the image being formed of a decolorable material that is decolored when heated to a predetermined temperature or higher;

a heating roller configured to decolor the image on the sheet using heating; and a control unit configured to control a light intensity of the light emitted from the light emitting unit based on a temperature of the heating roller.

15. The apparatus according to claim 14, wherein the control unit is further configured to operate a current processing job in either of a first mode in which a reading process of the document reading unit is performed and a decoloring process in the heating roller is not performed, and a second mode in which the reading process is performed and the decoloring process is performed, such that in the first mode, the light intensity of the light emitting unit is controlled based on:

a temperature of a heating roller which heats the sheet, and a number of sheets subjected to the decoloring process performed in the heating roller during a processing job immediately prior to the current processing job.

16. The apparatus according to claim 15, wherein when the control unit is operating the current processing job in the first mode:

the control unit sets a current in the light emitting unit to a first predetermined current value if a number of sheets subjected to the reading process performed in the document reading unit during the current processing job is less than a predetermined number, and if the temperature of the heating roller is less than a predetermined temperature, and the control unit sets the current in the light emitting unit to a second predetermined current value larger than the first predetermined current value if the number of sheets subjected to the reading process in the document reading unit is equal to or greater than the predetermined number, and if current temperature of the heating roller is equal to or greater than a predetermined setting temperature.

17. The apparatus according to claim 15, wherein when the control unit is operating the current processing job in the second mode:

the control unit sets a current in the light emitting unit to a first predetermined current value if a number of sheets subjected to the reading process performed in the document reading unit during the current processing job is less than a predetermined number, and the control unit sets the current in the light emitting unit to a second predetermined current value larger than the first predetermined current value if the number of sheets subjected to the reading process in the document reading unit is equal to or greater than the predetermined number.

18. The apparatus according to claim 14, wherein the control unit controls the light intensity of the light emitting unit in a current processing job based on:

a number of sheets subjected to the decoloring process performed by the heating roller during a processing job immediately prior to the current processing job, and a temperature of the heating roller.

19. The apparatus according to claim 18, wherein the temperature of the heating roller is a temperature predicted from an elapsed time after the heating roller is energized.

* * * * *